United States Patent [19]

Sera et al.

[11] 4,173,481

[45] Nov. 6, 1979

[54] METHOD OF HARDENING GELATIN AND PHOTOGRAPHIC LIGHT-SENSITIVE MATERIAL

[75] Inventors: Hidefumi Sera; Tsumoru Ishii; June Yamaguchi; Hisashi Shiraishi, all of Minami-ashigara, Japan

[73] Assignee: Fuji Photo Film Co., Ltd., Minami-ashigara, Japan

[21] Appl. No.: 847,520

[22] Filed: Nov. 1, 1977

[30] Foreign Application Priority Data

Nov. 4, 1976 [JP] Japan ..... 51/132929

[51] Int. Cl.[2] ..... G03C 1/30

[52] U.S. Cl. ..... 430/621; 260/117; 106/125

[58] Field of Search ..... 96/111; 260/117; 106/125

[56] References Cited

U.S. PATENT DOCUMENTS

| | | | |
|---|---|---|---|
| Re. 29,305 | 7/1977 | Burness et al. | 96/111 |
| 3,749,573 | 7/1973 | Froehlich | 96/111 |
| 4,010,035 | 3/1977 | Fujiwhara et al. | 96/111 |

*Primary Examiner*—Won H. Louie, Jr.

*Attorney, Agent, or Firm*—Sughrue, Rothwell, Mion, Zinn and Macpeak

[57] ABSTRACT

A photographic silver halide light-sensitive material having at least one hydrophilic colloid layer containing gelatin and/or a gelatin derivative hardened with a compound represented by the following general formula (I):

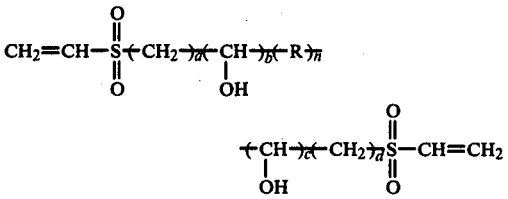

(I)

wherein a and d each represents 1 or 2; b and c each represents 0, 1 or 2 with the proviso that both b and c are not simultaneously 0; R represents a divalent group; and n is 0 or 1, which compound provides a preferred hardening rate and does not adversely affect the photographic properties of photographic light-sensitive materials, and a method of hardening gelatin and/or a gelatin derivative comprising treating the gelatin and/or the gelatin derivative with a compound represented by the general formula (I) above.

9 Claims, No Drawings

METHOD OF HARDENING GELATIN AND PHOTOGRAPHIC LIGHT-SENSITIVE MATERIAL

BACKGROUND OF THE INVENTION

1. Field of the Invention

The present invention relates to a method of hardening gelatin and/or a gelatin derivative with an improved hardening agent, more particularly, it relates to a method of hardening a hydrophilic colloid layer containing gelatin and/or a gelatin derivative of a silver halide photographic light-sensitive material and to the silver halide photographic light-sensitive material.

2. Description of the Prior Art

Gelatin is used as a binder for many photographic light-sensitive materials. For example, gelatin is used as the main component of a silver halide light-sensitive emulsion layer, an emulsion protective layer, a filter layer, an intermediate layer, an antihalation layer, a backing layer, a film support subbing layer and a baryta layer.

These photographic materials containing gelatin are treated with various aqueous solutions having different pH's and temperatures. Since a layer containing gelatin which has not been treated with a hardening agent has properties mainly dependent on the gelatin, it has poor water resistance and swells excessively in an aqueous solution, so that the mechanical strength is greatly reduced, and, in an extreme case, the gelatin layer is sometimes dissolved, particularly in an aqueous solution having a high temperature of above 30° C. or a highly alkaline aqueous solution. These properties are fatal defects for the physical properties of layers which make up photographic light-sensitive materials.

Many compounds are known to be effective for increasing the water resistance, heat resistance and abrasion resistance of a gelatin layer by hardening.

These compounds are well known as hardeners which are used in the production of photographic light-sensitive materials. Examples of known hardeners are formaldehyde, glutaraldehyde and like aldehyde type compounds; compounds having a reactive halogen as described in U.S. Pat. No. 3,288,775 and so on; compounds containing a reactive ethylenically unsaturated bond as described in U.S. Pat. No. 3,635,718 and so on; aziridine type compounds as described in U.S. Pat. No. 3,017,280, etc.; epoxy compounds as described in U.S. Pat. No. 3,091,537, etc.; and halocarboxyaldehydes such as mucochloric acid, dioxanes such as dihydroxydioxane and dichlorodioxane, or inorganic hardeners such as chromium alum and zirconium sulfate and the like.

However, these known gelatin hardeners have one or more deffects, when they are used in photographic light-sensitive materials, in that the hardening effect is insufficient, in that the gelatin hardening rate is not sufficiently fast, so that the hardening proceeds slowly with the passage of time after the production of the photographic materials (i.e., after-hardening), in that harmful effects to the properties of the photographic light-sensitive materials occur (particularly, increase of fog, decrease of sensitivity, etc.), in that the hardening effect is destroyed by other photographic additives which are present, in that they adversely affect other photographic additives (for example, color forming couplers for color photographic light-sensitive materials), in that the preparation thereof is difficult and large scale production is not appropriate, in that the hardeners per se are unstable and storage thereof is difficult, in that they have a very strong odor which causes a decrease in work efficiency during production thereof, in that they are harmful to the human body, and the like.

It is also known that hardeners having active vinyl sulfone groups are relatively advantageous for hardening purposes. For example, divinylsulfone, which is an example of a hardener, is not practically used due to its quite harmful affects on the human body. Compounds having vinylsulfonyl groups in which such a defect is decreased are described in German Pat. No. 1,100,942, U.S. Pat. No. 3,490,911, etc.

Those vinylsulfone type hardeners have advantages as hardeners because they have generally a high hardening rate and a small after-hardening effect which is a variation of hardening effect with the passage of time, because they have less harmful effects on photographic properties such as fog formation, desensitization, etc., and because they have relatively less adverse affects on color photographic emulsions such as decoloration, etc.

However, these vinylsulfone compounds are expensive or a special method is required for their production in which a large amount of organic solvents is used in order to utilize these compounds and thus it cannot always be said that they are sufficient for practical use.

For example, since the compounds described in German Pat. No. 1,622,260 have poor water solubility, when they are used for the production of photographic light-sensitive materials, they tend to deposit in a gelatin solution nd cause difficulties during coating and an uneven hardening of the photographic layer. Further, it is essential to use a large amount of an organic solvent which involves risks of fire and explosion and is undesirable in view of the harmful effects on the human body.

The compounds described in U.S. Pat. No. 3,642,486 are improved in this point. That is, these compounds have a good solubility due to ether bonds present in the compounds and are advantageous in the production of photographic light-sensitive materials. However, a compound which is known to induce cancer is used as a starting material in the production of the compounds described in U.S. Pat. No. 3,642,486 and, thus, the production of these compounds involves a large risk.Further, mass production is also disadvantgeous, since these compounds are relatively hard to crystallize because of the presence of ether bonds. Furthermore, gelatin layers or photographic light-sensitive materials hardened with these compounds have poor resistance to dissolution in an aqueous alkaline solution and this is quite a defect when it is considered that developer solutions for photographic light-sensitive materials are most generally highly alkaline aqueous solutions.

The compounds described in Japanese patent application (OPI) No. 44164/1976 have improved solubility in an alkaline solution. However, these compounds have very poor water solubility and require the use of a large amount of organic solvent in the production of photographic light-sensitive materials which is extremely disadvantageous in view of minimizing the hazards of explosion, providing safe working conditions and preventing environmental pollution.

The compounds described in Japanese patent application (OPI) Nos. 74832/1973 and 24435/1974 have improved water solubility and reduced toxicity due to the function of a polar group introduced into their molecules, that is, an acylamide bond. However, the compounds described in Japanese patent application (OPI)

No. 74832/1973 require use of acylamide which is highly poisonous to produce. Also, the compounds described in Japanese patent application (OPI) No. 24435/1974 require the use of 1,3,5-triacyloylhexahydro-s-triazine which has a relatively high cost of production and, further, they are only soluble in water substantially up to about 2 weight % at room temperature (about 25° C.). In addition, the melting points and solubilities of the compounds described in Japanese patent application (OPI) No. 24435/1974 are interrelated and compounds having a higher purity have higher melting points and lower solubilities than those described in Japanese patent application (OPI) No. 24435/1974.

SUMMARY OF THE INVENTION

It has now been discovered that almost all of the disadvantages of known hardeners are improved and the advantages described hereinbelow are obtained in the method of this invention comprising treating a hydrophilic colloid layer containing gelatin and/or a gelatin derivative with a compound represented by the following general formula (I):

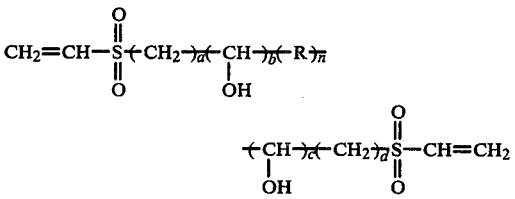

(I)

wherein a and d each represents 1 or 2; b and c each represents 0, 1 or 2 with the proviso that both b and c are not simultaneously O; R represents a divalent group; and n represents 0 or 1.

The hardeners which are used in the present invention are completely free from these defects and are quite ideal compounds as hardeners which can be used in the production of photographic light-sensitive materials.

In greater detail, the hardeners used in the present invention have a very good solubility in water, i.e., they are soluble to an extent of more than about 8 weight % at room temperature and more than about 20 weight % with slight heating at about 40° C. This has a very important meaning. That is, the larger the amount of water which is required in order to use a hardener in the production of photographic light-sensitive materials, the larger is the drying load for removing the water and this leads to higher energy costs, a larger space and larger equipment needs for drying and decreases in productivity. Further, photographic light-sensitive materials are nowadays produced at a higher speed and, for instance, when extrusion coating using a slide hopper is employed for coating, the gelatin solution or the emulsion solution to be coated must have a certain high viscosity. However, the use of a large amount of water in order to add a hardener to a solution has the apparent tendency to reduce the viscosity of the solution and may occasionally result in fatal defects.

Therefore, a very important advantage in the photographic art is for the solubility of the hardener in water to be more than about 7 weight %. In addition, since the present hardeners have a strong hardening effect per unit weight, a small amount of the compounds can be used in comparison with other hardeners and, thus, the amount of water used can be further reduced.

Also, a gelatin or gelatin derivative (hereinafter fo simplicity the term "gelatin" will be used to describ both gelatin and gelatin derivatives) or light-sensitiv layer hardened with the hardener according to the pres ent invention has extremely high resistance to dissolu tion in an alkaline solution.

The hardener used in the present invention has a very high activity and exhibits a rapid hardening effect sc that the variation of hardening effect with the passage of time, i.e., the so-called after-hardening, is not observed. In spite of its high activity, the compound is stable and an aqueous solution thereof possesses a very good storage stability.

Not only does the hardening reaction take place rapidly and after hardening does not occur with the present hardener, but also it is relatively unaffected by temperature and/or humidity during the drying process and/or during storage after drying.

Further, the hardener used in the present invention can be prepared in a high yield from a very common compound such as an epoxy compound or a chlorohydrin type compound as described hereinafter and, thus, can be obtained at a low production cost. Also, the compound is easily crystallized due to the presence of a hydroxy group in the molecule thereof and is easy to produce. Furthermore, the vapor pressure thereof is low and it is odorless which is advantageous in handling.

Moreover, the hardener used in the present invention does not interact with other photographic additives which are present such as color forming couplers for color photographic materials and, thus, the present hardener does not reduce the effects of such photographic additives, nor is the hardening effect of the present hardener destroyed. In addition, the hardener does not adversely affect the properties of photographic light-sensitive materials (for example, cause fog, reduce sensitivity, etc.).

DETAILED DESCRIPTION OF THE INVENTION

In the above general formula (I), the divalent group represented by R includes any divalent group, but preferably a cyclic hydrocarbon group such as an arylene group having 6 to 12 carbon atoms, e.g., an m-phenylene group, etc., an acyclic hydrocarbon group such as an alkylene group having 1 to 8 carbon atoms, e.g., a methylene group, an ethylene group, a trimethylene group, a tetramethylene group, etc. The divalent group represented by R can also be an aralkylene group having a total of 8 to 10 carbon atoms. One to three of the carbon atoms of the group defined above for R can be replaced by a hetero atom such as a nitrogen atom, a sulfur atom, an oxygen atom, etc. Suitable examples of groups containing hetero atom(s) include a group containing a $-CH_2OCH_2-$ group, a $-(CH_2CH_2O)_2-CH_2CH_2-$ group, a $-CH_2CH_2OCH_2CH_2-$ group, a

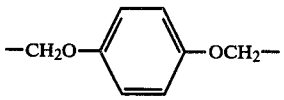

group, etc. More preferably R is a divalent branched or straight chain alkylene group having 1 to 4 carbon atoms. Also, the chain can be substituted, for example, with one or more of an alkoxy group having 1 to 4 carbon atoms such as a methoxy group, an ethoxy group, etc., a halogen atom such as a chlorine atom, a bromine atom, etc., a hydroxy group, an acetoxy group and the like.

Further, preferred compounds of the general formula (I) are those in which a, b, c, d and R are so selected that the relationship represented by the following equation is fulfilled.

$$\frac{\text{Molecular Weight}}{\text{Number of Hydroxy Groups Present per Molecule}} \leqq 260$$

That is, it is preferred for the numerical value obtained by dividing the molecular weight by the total number of hydroxy groups per molecule is about 260 or less. When the numerical value is greater than about 260, the water solubility which is one of the advantages according to the present invention is reduced.

of a catalyst such as pyridine, dimethylformamide, etc., at about −20° to about 200° C. and at atmospheric pressure for about 10 minutes to several days, or by chlorinating a hydroxyethylsulfide and then oxidzing the product obtained. Furthermore, the hydroxyethylsulfide, i.e., the starting material, can be easily prepared by reacting a compound having an epoxy group or a precursor thereof, i.e., a halo compound having a hydroxy group with mercaptoethanol in a solvent such as water, methanol, ethanol, dimethylformamide, etc., in the presence of a catalyst such as potassium hydroxide, sodium hydroxide, triethylamine, etc., at about −40° to about 120° C. and at atmospheric pressure for about 10 minutes to several days.

Examples of compounds of the general formula (I) which can be used in the present invention are given below, but the present invention is not to be construed as being limited to these examples.

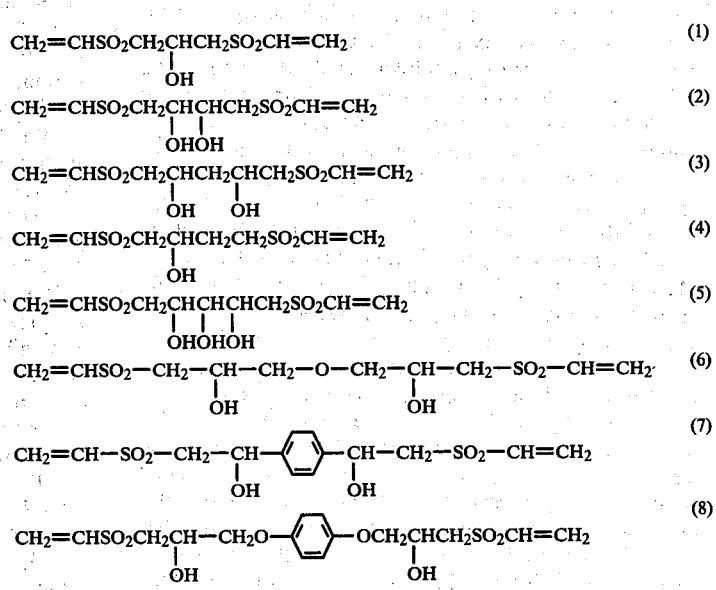

(1) $CH_2{=}CHSO_2CH_2CH(OH)CH_2SO_2CH{=}CH_2$ (2) $CH_2{=}CHSO_2CH_2CH(OH)CH(OH)CH_2SO_2CH{=}CH_2$ (3) $CH_2{=}CHSO_2CH_2CH(OH)CH_2CH(OH)CH_2SO_2CH{=}CH_2$ (4) $CH_2{=}CHSO_2CH_2CH(OH)CH_2CH_2SO_2CH{=}CH_2$ (5) $CH_2{=}CHSO_2CH_2CH(OH)CH(OH)CH(OH)CH_2SO_2CH{=}CH_2$ (6) $CH_2{=}CHSO_2{-}CH_2{-}CH(OH){-}CH_2{-}O{-}CH_2{-}CH(OH){-}CH_2{-}SO_2{-}CH{=}CH_2$ (7) $CH_2{=}CH{-}SO_2{-}CH_2{-}CH(OH){-}C_6H_4{-}CH(OH){-}CH_2{-}SO_2{-}CH{=}CH_2$ (8) $CH_2{=}CHSO_2CH_2CH(OH){-}CH_2O{-}C_6H_4{-}OCH_2CH(OH)CH_2SO_2CH{=}CH_2$

The hardeners used in the present invention are all novel compounds and can be prepared in good yield using known general reactions. Tht is, the vinylsulfonyl compounds of the general formula (I) can be prepared according to general methods for forming a vinyl group, for example, by dehydrochlorinating a haloethylsulfonyl compound such as a chloroethylsulfonyl compound, etc., using a base such as triethylamine, trimethylamine, triethylenediamine, 1,8-diazobicyclo[5,4,0]-7-undecene, etc., in a solvent such as acetone, acetonitrile, chloroform, benzene, etc., at −60° to 80° C. at atmospheric pressure for about 10 minutes to several days, or by dehydrating a hydroxyethylsulfonyl compound. Further, the chloroethylsulfonyl compound, i.e., the starting material, can be prepared, for example, by oxidizing a hydroxyethylsulfide using an oxidizing agent such as hydrogen peroxide, peracetic acid, etc., in a solvent such as water, acetic acid, ethyl acetate, acetone, methanol, etc., in the presence of a catalyst such as tungstic acid, phosphoric acid, acetic acid, etc., at 0° to 120° C. and at atmospheric pressure for about 10 minutes to several days to form a hydroxyethylsulfone and chlorinating this hydroxyethylsulfone using a chlorinating agent such as thionyl chloride, phosphorus pentachloride, phosphorus trichloride, etc., in the absence of a solvent or in the presence of a solvent such as chloroform, toluene, etc., in the presence The amount of the hardener of the present invention used can be selected freely depending on the desired objective. The amount used generally ranges from about 0.01 to about 20 wt%, preferably ranges from 0.1 to 10 wt%, based on the weight of dry gelatin. When the hardener of the present invention is used in an amount of more than about 20 wt% based on the weight of the dry gelatin, the gelatin solution is occasionally gelled and hardened, so that it is impossible to use the gelatin aqueous solution containing the hardener, e.g., it is impossible to form a film by coating or spray coating. On the other hand, with the amount of the hardener of the present invention used is less than about 0.01 wt%, sufficient hardening cannot be obtained even after drying, and insufficient film strength is obtained, although it is possible to form a film using the gelatin aqueous solution. Use of an amount in the above range provides the ability to rapidly harden gelatin, which is an advantage of the hardener of the present invention, and such can be achieved satisfactorily.

The hardeners of the present invention can be used individually or as mixtures of two or more hardeners of the present invention. Further, the hardeners of the present invention can be used in combination with other known hardeners. Suitable known hardeners which can be used therewith are, for example, formaldehyde, glutaraldehyde and like aldehyde type compounds, diacetyl, cyclopentadione and like ketone compounds, bis(2-chloroethylurea), 2-hydroxy-4,6-dichloro-1,3,5-triazine; and other compounds containing a reactive halogen as described in U.S. Pat. Nos. 3,288,775 and 2,732,303 and British Pat. Nos. 974,723 and 1,167,207; divinylsulfone, 5-acetyl-1,3-diacryloylhexahydro-1,3,5-triazine and other compounds containing a reactive olefin bond as described in U.S. Pat. Nos. 3,635,718 and 3,232,763 and British Pat. No. 994,869; N-hydroxymethylphthalimide, and other N-methylol compounds as described in U.S. Pat. Nos. 2,732,316 and 2,586,168; isocyanates as described in U.S. Pat. No. 3,103,437; aziridine compounds as described in U.S. Pat. Nos. 3,017,280 and 2,983,611; acid derivatives as described in U.S. Pat. Nos. 2,725,294 and 2,725,295; carbodiimide type compounds as described in U.S. Pat. No. 3,100,704; epoxy compounds as described in U.S. Pat. No. 3,091,537; isoxazole type compounds as described in U.S. Pat. Nos. 3,321,313 and 3,543,292; halocarboxyaldehydes such as mucochloric acid; dioxane derivatives such as dihydroxydioxane and dichlorodioxane; and inorganic hardeners such as chromium alum and zirconium sulfate. In addition to the above hardening compounds, the hardeners of the present invention can be used in combination with precursors of the above-described compounds, such as alkali metal bisulfite aldehyde adducts, methylol derivatives of hydantoin and primary fatty nitroalcohols, etc. When using the hardener of the present invention in combination with other hardeners, the amount of the hardener(s) of the present invention used can be selected as desired depending on the object and the effect.

In using the hardener of the present invention for photographic light-sensitive materials, a silver halide emulsion can be prepared by mixing a water-soluble silver salt (e.g., silver nitrate) solution and a water-soluble halide (e.g., potassium bromide) solution in the presence of a water-soluble polymer (e.g., gelatin) solution. Useful silver halides include silver chloride, silver bromide and mixed silver halides such as silver chlorobromide, silver iodobromide and silver chloroiodobromide, etc.

The form of the silver halide grains may be any of a cubic, octahedral and mixed system. The grain size and average grain size distribution are not particularly limited, and any grain size and grain size distribution can be used.

These silver halide grains can be prepared using known conventional procedures, e.g., a single or double jet method, a controlled double jet method and the like. Further, two or more kinds of silver halide emulsions which have been separately prepared may be mixed.

The crystal structure of the silver halide grains may be uniform throughout the grains, the grains may be heterogeneous where the outer layer and an inner layer are different or the grains may be of the conversion type as described in British Pat. No. 635,841 and U.S. Pat. No. 3,622,318. Further, the grains may be of the type which form a latent image principally on the surface of the grains or may be of the inner latent image type which form a latent image in the interior of the grains. These photographic emulsions are described in C. E. K. Mees & T. H. James, *The Theory of the Photographic Process,* 3rd Ed., Macmillan, New York (1967); P. Grafkides, *Chimie Photographique,* Paul Montel, Paris (1957) and the like, and can be prepared using known methods such as the ammonia method, the neutral method, the acid method and the like.

After the formation of such silver halide grains, water-soluble salt by-products (e.g., potassium nitrate when producing silver bromide from silver nitrate and potassium bromide) can be removed from the system by water-washing, and then heating is conducted in the presence of a chemical sensitizer such as sodium thiosulfate, N,N,N'-trimethylthiourea, a thiocyanate complex salt of monovalent gold, a thiosulfate complex salt of monovalent gold, stannous chloride or hexamethylenetetramine without coarsening the grains to thereby increase the sensitivity. Such a procedure is described in the abpve-cited references.

The above silver halide emulsions can be chemically sensitized using conventional techniques, if desired. Chemical sensitizers which can be used include, for example, chloroaurate, auric chloride and like gold compounds as described in U.S. Pat. Nos. 2,399,083, 2,540,085, 2,597,856 and 2,597,915; salts of noble metals such as platinum, palladium, iridium, rhodium and ruthenium as described in U.S. Pat. Nos. 2,448,060, 2,540,086, 2,566,245, 2,566,263 and 2,598,079; sulfur compounds forming silver sulfide upon reaction with a silver salt, as described in U.S. Pat. Nos. 1,574,944, 2,410,689, 3,189,458 and 3,501,313; stannous salts, amines and other reducing materials, as described in U.S. Pat. Nos. 2,487,850, 2,518;698, 2,521,925, 2,521,926, 2,694,637, 2,983,610 and 3,201,254.

The photographic emulsion in which the hardener of the present invention is employed can, if desired, be spectrally sensitized or supersensitized by the use of cyanine, merocyanine, carbocyanine and like cyanine dyes, individually or in combination, or in combination with styryl dyes.

Such dye sensitizing techniques are well known and are described in U.S. Pat. Nos. 2,493,748, 2,519,001, 2,977,229, 3,480,434, 3,672,897, 3,703,377, 2,688,545, 2,912,329, 3,397,060, 3,615,635, 3,628,964, British Pat. Nos. 1,195,302, 1,242,588 and 1,293,862, German patent application (OLS) Nos. 2,030,326 and 2,121,780, Japanese Pat. Nos. 4936/1968, 14030/1969 and 10773/1968, U.S. Pat. Nos. 3,511,664, 3,522,052, 3,527,641, 3,615,613, 3,615,632, 3,617,295, 3,635,721, 3,694,217, British Pat. Nos. 1,137,580 and 1,216,203 and the like. The material(s) can freely be selected depending on the wavelength range to which the emulsion is to be sensitized, the sensitivity desired, the end-use objective and the like.

Various compounds can be added to the above photographic emulsion in order to prevent a reduction in sensitivity and a generation of fog during the manufacture, storage or processing of the photographic materials. Many such compounds are known, for example, 4-hydroxy-6-methyl-1,3,3a,7-tetrazaindene, 3-methylbenzothiazole, 1-phenyl-5-mercaptotetrazole and like heterocyclic compounds, mercury containing compounds, mercapto compounds and metal salts. Examples of usable compounds are described in C. E. K. Mees & T. H. James, *The Theory of the Photographic Process,* 3rd Ed., pp. 344–349, Macmillan, New York (1966) and the original literature references cited therein; and in the following patents: U.S. Pat. Nos. 1,758,576, 2,110,178, 2,131,038, 2,173,628, 2,697,040, 2,304,962, 2,324,123, 2,394,198, 2,444,605–8, 2,566,245, 2,694,716, 2,697,099, 2,708,162, 2,728,663–5, 2,576,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, 3,622,339, British Pat. Nos. 893,428, 403,789, 1,173,609 and 1,200,188.

The gelatin to which the hardener of the present invention can be applied can be any type of gelatin such as alkali treated gelatin obtained by immersion in an alkali bath (lime-treatment) before gelatin extraction, acid treated gelatin obtained by immersion in an acid bath and enzyme treated gelatin as described in *Bull. Soc. Sci. Photo. Japan,* No. 16, page 30 (1966). Further, the present hardener can be applied to the low molecular weight gelatin which is obtained by partial hydrolysis of gelatin by heating in a water bath or interaction with protenase.

The gelatin to which the hardener of the present invention is applied may, if desired, be partially replaced by colloidal albumin, casein, cellulose derivatives such as carboxymethylcellulose and hydroxyethylcellulose, agar, sodium alginate, starch derivatives and like saccharide derivatives, and synthetic hydrophilic colloids such as polyvinyl alcohol, poly-N-vinyl pyrrolidone, polyacrylic acid copolymers, polyacrylamide and the derivatives or partially hydrolyzed products thereof. In addition, the gelatin may be replaced by a gelatin derivative which is obtained by treating or modifying the amino, imino, hydroxy or carboxyl groups present as functional groups in the gelatin molecule with an agent having a group capable of reacting with such functional groups, or may be replaced by a graft gelatin in which a molecular chain of another polymeric material is grafted onto the gelatin molecule.

Agents for producing the above gelatin derivatives include, for example, isocyanates, acid chlorides or acid anhydrides as described in U.S. Pat. No. 2,614,928; acid anhydrides as described in U.S. Pat. No. 3,118,766; bromoacetic acids as described in Japanese Pat. No. 5514/1964; phenylglycidyl ethers as described in Japanese Pat. No. 26845/1967; vinylsulfone compounds as described in U.S. Pat. No. 3,132,945; N-allylvinylsulfonamides as described in British Pat. No. 861,414; maleinimide compounds as described in U.S. Pat. No. 3,186,846; acrylonitriles as described in U.S. Pat. No. 2,594,293; polyalkylene oxides as described in U.S. Pat. No. 3,312,553; epoxy compounds as described in Japanese Pat. No. 26845/1967; acid esters as described in U.S. Pat. No. 2,763,739; and alkanesultones as described in British Pat. No. 1,033,189.

Suitable polymers which can be grafted onto the gelatin molecule are described in many literature publications such as U.S. Pat. Nos. 2,763,625, 2,831,767 and 2,956,884, *Polymer Letters,* 5, 595 (1967), *Photo Sci. Eng.,* 9, 148 (1965), *J. Polymer Sci.,* A-1, 9, 3199 (1971) and the like, and polymers or copolymers of vinyl monomers such as acrylic acid, methacrylic acid, or the esters, amides, nitriles and like derivatives thereof, or styrene, may be used. Hydrophilic vinyl polymers compatible to some extent with gelatin, such as polymers or copolymers of acrylic acid, acrylamide, methacrylamide, hydroxyalkyl acrylates and hydroxyalkyl methacrylates are particularly preferred.

In using the hardener of the present invention in photographic light-sensitive materials, the photographic emulsion layer or other layers may contain therein synthetic polymer compounds, e.g., latex-like water dispersable polymers of vinyl compounds, particularly compounds which increase the dimensional stability of the photographic materials, individually or as a mixture thereof (a mixture of different kinds of polymers), or in combination with hydrophilic water-permeable colloids. Many such polymers are described, for example, in U.S. Pat. Nos. 2,376,005, 2,739,137, 2,853,457, 3,062,674, 3,411,911, 3,488,708, 3,525,620, 3,635,715, 3,607,290, 3,645,740 and in British Pat. Nos. 1,186,699 and 1,307,373. Of these compounds, copolymers and homopolymers of monomers selected from alkyl acrylates, alkyl methacrylates, acrylic acid, methacrylic acid, sulfoalkyl acrylates, sulfoalkyl methacrylates, glycidyl acrylates, glycidyl methacrylates, hydroxyalkyl acrylates, hydroxyalkyl methacrylates, alkoxyalkyl acrylates, alkoxyalkyl methacrylates, styrene, butadiene, vinyl chloride, vinylidene chloride, maleic anhydride and itaconic anhydride are generally used. If desired, a graft type emulsion polymerization latex obtained by emulsion polymerizing the above-described vinyl compounds in the presence of a hydrophilic protective colloidal polymer compound may be used.

The gelatin hardener of the present invention may be used in the photographic light-sensitive materials in combination with a matting agent. Examples of matting agents which may be used include particles of water-insoluble organic or inorganic compounds, with an average particle size of about 0.2$\mu$ to about 10$\mu$, preferably 0.3 to 5$\mu$. Examples of suitable organic compounds which can be used are water-dispersable vinyl polymers such as polymethyl acrylate, polymethyl methacrylate, polyacrylonitrile, acrylonitrile-$\alpha$-methylstyrene copolymers, polystyrene, styrene-divinylbenzene copolymers, polyvinyl acetate, polyethylene carbonate, polytetrafluoroethylene; cellulose derivatives such as methyl cellulose, ethyl cellulose, cellulose acetate, cellulose acetate propionate; starch derivatives such as carboxy starch, carboxynitrophenyl starch, urea-formaldehyde-starch reaction products; and gelatin hardened with known hardeners and hollow microcapsules of hardened gelatin, which is obtained by hardening of a coacervate. Examples of inorganic compounds which can be used are silicon dioxide; titanium dioxide; magnesium oxide; aluminum oxide; barium sulfate; calcium carbonate; silver chloride and silver bromide desensitized using known methods; glass and the like. The above matting agents may, if desired, be used individually or as a mixture of two or more thereof.

The gelatin hardener of the present invention may be used in the photographic light-sensitive materials in combination with one or more couplers. In this case, diffusion resistant couplers can be incorporated in a silver halide emulsion layer.

Examples of suitable couplers which can be used are 4-equivalent diketomethylene yellow couplers and 2-equivalent diketomethylene yellow couplers, for example, compounds as described in U.S. Pat. Nos. 3,415,652, 3,447,928, 3,311,476 and 3,408,194; compounds as described in U.S. Pat. Nos. 2,875,057, 3,265,506, 3,409,439, 3,551,155 and 3,551,156; compounds as described in Japanese patent application (OPI) Nos. 26133/1972 and 66836/1973; 4-equivalent or 2-equivalent pyrazolone magenta couplers and indazolone magenta couplers, for example, compounds as described in U.S. Pat. Nos. 2,600,788, 2,983,608, 3,062,653, 3,214,437, 3,253,924, 3,419,391, 3,419,808, 3,476,560 and 3,582,322, Japanese Pat. No. 20636/1970, Japanese patent application (OPI) No. 26133/1972; $\alpha$-naphthol type cyan couplers and phenol type cyan couplers, for example, compounds as described in U.S. Pat. Nos. 2,474,293, 2,698,794, 3,034,892, 3,214,437, 3,253,924, 3,311,476, 3,458,315, 3,591,383, Japanese Pat. Nos. 11304/1967 and 32461/1969. In addition, the compounds as described in U.S. Pat. Nos. 3,227,554, 3,297,445, 3,253,924, 3,311,476, 3,379,529, 3,516,831, 3,617,291, 3,705,801, German patent application (OLS) No. 2,163,811, etc., can be used.

Surface active agents individually or in admixture may be added to the photographic emulsion of the photographic light-sensitive materials, to which the hardener of the present invention is applied. Although such surface active agents are generally used as coating aids, they may also be used for other purposes, for example, for the purposes of emulsification and dispersion, sensitization, improvement of photographic properties, prevention of the generation of static charges and prevention of adhesion.

These surface active agents can be classified as naturally occurring surface active agents such as saponin; nonionic surface active agents such as those of the alkylene oxide type, the glycerin type and the glycidol type; cationic surface active agents such as higher alkylamines, quaternary ammonium salts, pyridine and like heterocyclic compounds, phosphoniums and sulfoniums; anionic surface active agents containing acidic groups such as carboxylic acid, sulfonic acid, phosphoric acid, sulfuric acid ester and phosphoric acid esters; and amphoteric surface active agents such as amino acids, amino sulfonic acids, and sulfates or phosphates of amino alcohols.

Specific examples of useful surface active agents are described not only in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, German patent application (OLS) No. 1,942,665, British Pat. Nos. 1,077,317, 1,198,450, but also in references such as Ryohei Oda, *Synthesis and Application of Surface Active Agents,* Maki Publisher, Tokyo (1964), A. W. Schwartz et al., *Surface Active Agents,* Interscience Publications Incorporated, (1958), J. P. Sisley, *Encyclopedia of Surface Active Agents,* Vol. 2, Chemical Publishing Company (1964) and the like.

The photographic emulsions described above can be coated on a planar support which does not undergo any substantial dimensional change during processing, for example, rigid supports such as glass, metal and ceramics, and flexible supports, depending on the objective.

Representative examples of flexible supports include those generally used for photographic light-sensitive materials such as cellulose nitrate films, cellulose acetate films, cellulose acetate butyrate films, cellulose acetate propionate films, polystyrene films, polyethylene terephthalate films, polycarbonate films and laminates thereof; thin glass films; paper coated with baryta; papers coated or laminated with an α-olefin polymer, particularly a polymer of an α-olefin containing 2 to 10 carbon atoms, such as polyethylene, polypropylene and ethylene-butene copolymers; and synthetic resin films whose surface is roughened to thereby improve adhesion to other polymeric materials and to improve the printability thereof as described in Japanese Pat. No. 19068/1972.

Depending on the end-use of the photographic materials, transparent or opaque supports can be used. Suitable transparent supports can be not only colorless but also colored by the addition of dyes and/or pigments. Colored transparent supports have long been used in the production of X-ray films, and such is described in *J. SMPTE* 67, 296 (1958).

Suitable opaque supports include not only intrinsically opaque supports such as paper, but also opaque supports obtained by adding to a transparent film a dye and/or pigment such as titanium oxide, a surface treated synthetic resin film as described in Japanese Pat. No. 19068/1972, and papers and synthetic resin films which have been rendered completely light-shielding by the addition of carbon black or dyes.

When the adhesion strength between the support and the photographic emulsion layer is insufficient, a subbing layer which has a good adhesion for both is provided. In order to further improve the adhesion, the surface of the support can be subjected to a pre-treatment such as treatment with a corona discharge, an ultraviolet light irradiation or a flame treatment, etc.

In using the hardener of the present invention, each layer of the photographic light-sensitive materials can be coated using various coating methods including dip coating, air knife coating, curtain coating, spray coating, extrusion coating using a hopper as described in U.S. Pat. No. 2,681,294, etc. If desired, two or more layers can be simultaneously coated using the methods as described in U.S. Pat. Nos. 2,761,791, 3,508,947, 2,941,898 and 3,526,528.

The hardener according to the present invention can be used not only by incorporation in the photographic materials but also by addition to a processing solution. A suitable amount of the hardener of this invention used in a processing solution ranges from about 0.1 to about 10% by weight, preferably 0.2 to 5% by weight.

Examples of the synthesis of the compounds used in the present invention and Examples of the present invention are given below to illustrate the present invention in greater detail. Unless otherwise indicated, all parts, percents, ratios and the like are by weight.

SYNTHESIS EXAMPLE 1

Preparation of 1,3-bis(Hydroxyethylsulfonyl)-2-propanol 2.7 g of sodium hydroxide was dissolved in a solution of 60 ml of ethanol and 10 g of mercaptoethanol. To the solution, 5.9 g of epichlorohydrin was added dropwise at 60° C. with stirring. After stirring for 3 hours at 75° C., the mixture was cooled and filtered to remove crystals. The filtrate was concentrated and to which 50 ml of water and 0.2 g of sodium tungstate were added and the pH was adjusted to 6.0 with acetic acid. 24.5 g of a 34% by weight hydrogen peroxide aqueous solution was added dropwise at 70° C. with stirring to the mixture and the mixture was stirred for 3 hours at 75° C. The resulting solution was concentrated and the crystals obtained were recrystallized from methanol to obtain 16.2 g of white crystals.

| Elemental Analysis | C | H | S |
|---|---|---|---|
| Calculated (%): | 30.43 | 5.84 | 23.21 |
| Found (%): | 30.35 | 5.81 | 23.29 |

SYNTHESIS EXAMPLE 2

Preparation of 1,3-bis(Chloroethylsulfonyl)-2-propanol

To 10 g of 1,3-bis(hydroxyethylsulfonyl)-2-propanol obtained as described in Synthesis Example 1, a catalytic amount of pyridine was added, then 15 ml of thionyl chloride was added thereto, and the mixture was stirred for 2 hours at 50° C. The mixture was concentrated under reduced pressure, and the crystals obtained were recrystallized from water to obtain 9.2 g of white crystals.

| | Elemental Analysis | | | |
|---|---|---|---|---|
| | C | H | Cl | S |
| Calculated (%): | 26.84 | 4.51 | 22.64 | 20.47 |
| Found (%): | 26.82 | 4.50 | 22.61 | 20.40 |

SYNTHESIS EXAMPLE 3

Preparation of Compound 1: 1,3-bis(Vinylsulfonyl)-2-propanol 5.0 g of 1,3-bis(chloroethylsulfonyl)-2-propanol obtained as described in Synthesis Example 2 was dissolved in 50 ml of acetone. To the solution was added dropwise 3.3 g of triethylamine with stirring at room temperature. After removing the crystals by filtration, the filtrate was concentrated under reduced pressure to obtain crystals. The crystals were recrystallized from ethanol to obtain 3.1 g of white crystals.

| | Elemental Analysis | | |
|---|---|---|---|
| | C | H | S |
| Calculated (%): | 34.99 | 5.03 | 26.69 |
| Found (%): | 34.99 | 5.11 | 26.57 |

SYNTHESIS EXAMPLE 4

Preparation of 1,4-bis(Hydroxyethylsulfonyl)-2,3-butanediol 8.3 g of sodium hydroxide, 100 ml of ethanol, 15.6 g of mercaptoethanol and 15.9 g of 1,4-dichloro-2,3-butanediol were reacted in the same manner as described in Synthesis Example 1 to obtain 29 g of white crystals.

| | Elemental Analysis | | |
|---|---|---|---|
| | C | H | S |
| Calculated (%): | 31.36 | 5.92 | 20.93 |
| Found (%): | 31.34 | 5.95 | 20.87 |

SYNTHESIS EXAMPLE 5

Preparation of 1,4-bis(Chloroethylsulfonyl)-2,3-butanediol

To 15.3 g of 1,4-(hydroxyethylsulfonyl)-2,3-butanediol obtained as described in Synthesis Example 4, a catalytic amount of dimethylformamide was added. 30 ml of thionyl chloride was reacted in the same manner as described in Synthesis Example 2 to obtain 13.7 g of white crystals.

| | Elemental Analysis | | | |
|---|---|---|---|---|
| | C | H | Cl | S |
| Calculated (%): | 27.99 | 4.70 | 20.66 | 18.68 |
| Found (%): | 28.03 | 4.71 | 20.61 | 18.69 |

SYNTHESIS EXAMPLE 6

Preparation of Compound 2: 1,4-bis(Vinylsulfonyl)-2,3-butanediol 11.4 g of 1,4-bis(chloroethylsulfonyl)-2,3-butanediol was dissolved in 300 ml of acetone and the same procedures as described in Synthesis Example 3 were followed using 6.8 g of triethylamine to obtain 7.6 g of white crystals.

| | Elemental Analysis | | |
|---|---|---|---|
| | C | H | S |
| Calculated (%): | 35.54 | 5.22 | 23.72 |
| Found (%): | 35.55 | 5.28 | 23.66 |

EXAMPLE 1

A silver iodobromide emulsion containing 6.0 mol % of silver iodide was optimally ripened using a sulfur-containing sensitizer and a gold sensitizer to prepare a high speed negative emulsion. To the emulsion were added anhydro-5,5'-tetrachloro-1,1'-diethyl-3,3'-di-(3-sulfopropyl)-benzimidazolocarbocyanine hydroxide as a spectral sensitizer, 4-hydroxy-6-methyl-1,3,3a,7-tetrazaindene as a stabilizer, and 1-(2,4,6-trichlorophenyl)-3-[3-(2,4-di-tert-amylphenoxyacetamide)benzamido]-5-pyrazolone (which was dissolved in tricresyl phosphate and ethyl acetate and dispersed in gelatin with sodium dodecylbenzenesulfonate) as a magenta color forming coupler to prepare an emulsion for a green-sensitive layer of a color negative light-sensitive material. The emulsion thus-obtained was divided into four portions and a first portion was used as control. To the other three portions were added an aqueous solution of Compound 1 of the present invention, dimethylol urea (Compound A) and mucochloric acid (Compound B), respectively, in an amount of 1.5 g per 100 g of dry gelatin. Each emulsion was coated on a subbed cellulose triacetate support in a coated coupler amount of $1.5\times10^{-3}$ mol/m$^2$ and dried.

These samples were exposed to green light using an NSG II type sensitometer and processed according to the color processing procedure as described in Example 1 of Japanese patent application (OPI) No. 51940/1976 as follows.

| | | |
|---|---|---|
| Processing Step (I) | | |
| Color Development | 38° C. | 3¼ min |
| Bleaching | " | 6½ min |
| Water Washing | " | 3¼ min |
| Fixing | " | 6½ min |
| Water Washing | " | 3½ min |
| Stabilizing | " | 1½ min |
| Drying | " | |
| Color Developer | | |
| Water Softener | | x g |
| Sodium Sulfite | | 2.0 g |
| Sodium Carbonate (monohydrate) | | 30 g |
| Potassium Bromide | | 2.0 g |
| Hydroxylamine Sulfate | | 3.0 g |
| 3-Methyl-4-amino-N-ethyl-N-β-hydroxyethyl Aniline Sulfate | | 5.0 g |
| Diethylenetriaminepentaacetic Acid | | 3.5 g/l |
| Water to make | | 1 l |
| Bleaching Solution | | |
| Ammonium Bromide | | 150 g |
| Aqueous Ammonia Solution (28%) | | 5 ml |
| Sodium Iron (III) Ethylenediamine-tetraacetate | | 100 g |

-continued

| | |
|---|---|
| Water to make | 1 l |
| Fixing Solution | |
| Sodium Tetrapolyphosphate | 2.0 g |
| Sodium Sulfite | 15 g |
| Ammonium Thiosulfate (70% aq. soln.) | 150 ml |
| Water to make | 1 l |
| Stabilizing Solution | |
| Formaldehyde | 5 ml |
| Water to make | 2 l |

The density of the magenta dye image thus-obtained was measured and fog, relative sensitivity and maximum density were determined. The results obtained are shown in Table 1 below.

TABLE 1

| Sample No. | Hardener | Fog | Relative Sensitivity | Maximum Density |
|---|---|---|---|---|
| 1 | None (control) | 0.12 | 100 | 2.95 |
| 2 | Compound 1 (present invention) | 0.10 | 92 | 2.80 |
| 3 | Compound A (comparison) | 0.18 | 90 | 1.98 |
| 4 | Compound B (comparison) | 0.14 | 85 | 2.70 |

As is apparent from the results in Table 1, in Sample 2, containing the compound according to the present invention, the color formation of the magenta dye is not prevented and the photographic properties are not adversely affected.

EXAMPLE 2

An emulsion for a green-sensitive layer of a color negative light-sensitive material obtained in the same manner as described in Example 1 was divided into four portions, a first portion was used as a control. To the other three portions were added an aqueous solution of Compound 1, 1,3,5-tris(β-vinylsulfonylpropyl)hexahydro-s-triazine (Compound C), bis(vinylsulfonylmethyl) ether (Compound D) in an amount of 1.5 g per 100 g of dry gelatin, respectively. Each emulsion was coated on a subbed polyethylene terephthalate support at a thickness of 5μ and dried.

The strength of the layer was determined using the two methods described below with samples stored at 25° C., 65% RH for 2 days or for 20 days and a sample heat treated at 50° C., 80% RH for 2 days.

(1) Strength of Layer Surface

A sample was immersed in water at 25° C. for 5 minutes. A pin equipped with a steel ball having a radius of 0.2 mm on the point thereof was pressed on the surface of the sample and the pin was moved at a rate of 5 mm per second on the surface of the sample while the load applied to the pin was continuously varied in the range of 0 to 100 g. The load (g) at which a scratch occurred on the surface was measured.

(2) Melting Time

A sample strip was immersed in a 0.2 N aqueous solution of sodium hydroxide at 60° C. and the time (min) when the emulsion layer began to melt was measured.

The results obtained are shown in Table 2.

TABLE 2

| Sample No. | Hardener | Strength of Layer Surface (g) | | | Melting Time (min) | | |
|---|---|---|---|---|---|---|---|
| | | 2 Days | 20 Days | 2 Days Heated | 2 Days | 20 Days | 2 Days Heated |
| 5 | None (control) | 2 | 3 | 8 | 0.2 | 0.3 | 0.5 |
| 6 | Compound 1 (present invention) | 68 | 76 | 81 | 13.5 | 27 | 30 |
| 7 | Compound C (comparison) | 13 | 20 | 26 | 1 | 2.5 | 3 |
| 8 | Compound D (comparison) | 28 | 33 | 35 | 7.5 | 13.5 | 15 |

It is apparent from the results in Table 2 that the compound according to the present invention has a superior hardening effect and provides improved strength for the layer surface and resistance to melting in comparison with other comparison vinylsulfone type hardeners.

EXAMPLE 3

A solution obtained by heating and dissolving a mixture of 52.3 g of α-pivaloyl-α-2,4-dioxo-5,5-dimethyl-3-hydantoinyl-2-chloro-5-[γ-(2,4-di-tert-amylphenoxy)-butyramido]-acetanilide, 55 ml of tri-n-hexyl phthalate and 100 ml of ethyl acetate was added to 1,000 ml of an aqueous solution containing 50 g of gelatin and 3.0 g of sodium cetylsulfate, and the mixture was dispersed to prepare a yellow coupler dispersion.

The dispersion was added to 1 kg of a photographic emulsion containing 0.3 mol of silver chlorobromide (silver chloride: 50 mol %) and 100 g of gelatin to prepare an emulsion for a blue-sensitive layer of a color print paper. The emulsion was divided into four portions. A first portion was used as control, and to the other three portions were added Compound 1 of the present invention, Compound D and 1,2-bis(vinylsulfonyl)ethane (Compound E), respectively, in an amount of $5\times10^{-5}$ mol per g of dry gelatin as solutions as shown in Table 3.

TABLE 3

| Sample No. | Hardener | Solvent | Concentration |
|---|---|---|---|
| 9 | None (control) | — | — |
| 10 | Compound 1 (present invention) | Water | 10 wt % |
| 11 | Compound D (comparison) | Water | 0.5 wt % |
| 12 | Compound E (comparison) | Methanol | 2 wt % |

In the case of Sample 10, since the compound of the present invention had a high solubility in water, the amount of the hardening solution added to the emulsion was small and the physical properties of the emulsion were not changed. On the contrary, in the case of Samples 11 and 12, the viscosities of the emulsions were reduced markedly because of the addition of a large amount of the hardening solution and the viscosities must be increased by adding poly-(styrenesulfonic acid) in order to achieve the required viscosity for coating.

These four emulsions were coated on a paper, both surfaces of which were laminated with polyethylene, as a support, in a dry thickness of 3.5μ and dried. With respect to Sample 11, in order to achieve the required thickness, it was necessary to increase the amount of the coating solution applied from the coater to the support or to decrease the travelling speed of the support and the time required for drying markedly increased, and many difficulties were encountered in the coating step. Further, in the case of Sample 12, the concentration of the organic solvent in the exhaust drying air increased and it was necessary to remove it to insure worker safety. On the contrary, such disadvantages were not encountered in Sample 10 using the compound according to the present invention.

EXAMPLE 4

A 5% solution of gelatin was divided into four portions, a first portion was used as a control and to the other three portions were added Compound 1 of the present invention, Compound B and Compound E in an amount of $5\times10^{-5}$ mol per g of dry gelatin, respectively. Each gelatin solution was coated on a subbed polyester film support and dried.

After storing the samples obtained under conditions of 25° C., 65% RH, the strength of the gelatin layer surface thereof was determined. The results obtained are shown in Table 4 below.

TABLE 4

| Sample No. | Hardener | Strength of Layer Surface (g) 2 Days | 7 Days | 14 Days | 21 Days |
|---|---|---|---|---|---|
| 13 | None (control) | 2 | 3 | 5 | 6 |
| 14 | Compound 1 (present invention) | 48 | 56 | 58 | 60 |
| 15 | Compound B (comparison) | 21 | 36 | 45 | 52 |
| 16 | Compound E (comparison) | 18 | 25 | 32 | 36 |

It is apparent from the results in Table 4 that the hardener of the present invention exhibited less after-hardening, had a high rate of hardening, and provided a gelatin layer having a strong layer surface strength and a mechanical strength resistant to severe processing procedures of high temperature and high speed.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least one silver halide emulsion layer with the photographic light-sensitive material having one hydrophilic colloid layer containing gelatin and/or a gelatin derivative hardened with a compound of the following general formula (I):

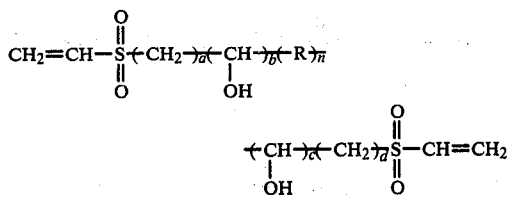

(I)

wherein a and d each represents 1 or 2; b and c each represents 0, 1 or 2 with the proviso that both b and c are not simultaneously 0; R represents a divalent group selected from the group consisting of a cyclic hydrocarbon group having 6 to 12 carbon atoms, an acyclic hydrocarbon group having 1 to 8 carbon atoms, a $-CH_2OCH_2-$ group, a $-(CH_2CH_2O)_2CH_2CH_2-$ group, a $-CH_2CH_2OCH_2CH_2-$ group and a

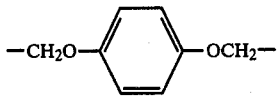

group; and is 0 or 1.

2. The photographic light-sensitive material as claimed in claim 1, wherein R is an alkylene group having 1 to 8 carbon atoms, an arylene group having 6 to 12 carbon or an aralkylene group having 8 to 10 carbon atoms.

3. The photographic light-sensitive material as claimed in claim 2, wherein R is a straight chain or branched chain alkylene group having 1 to 4 carbon atoms and which may be substituted with one or more of an alkoxy group having 1 to 4 carbon atoms, a halogen atom, a hydroxy group and an acetoxy group.

4. The photographic light-sensitive material as claimed in claim 1, wherein said compound of the general formula (I) is a compound in which the numerical value obtained by dividing the molecular weight by the total number of hydroxy groups per molecule is about 260 or less.

5. The photographic light-sensitive material as claimed in claim 1, wherein said compound of the general formula (I) is:

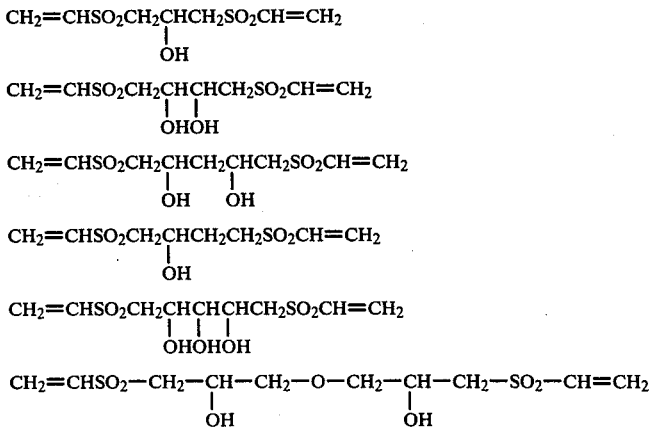

-continued

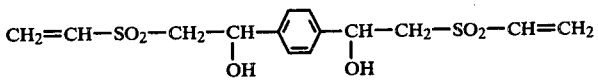

or

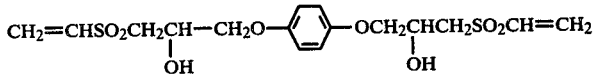

6. The photographic light-sensitive material as claimed in claim 1, wherein said compound of the general formula (I) is incorporated into said hydrophilic colloid layer in an amount ranging from about 0.01 to about 20 wt % based on the weight of dry gelatin.

7. The photographic light-sensitive material as claimed in claim 6, wherein the amount of said compound of the general formula (I) ranges from 0.1 to 10 wt % based on the weight of dry gelatin.

8. The photographic light-sensitive material as claimed in claim 1, wherein said hydrophilic colloid layer is a photographic silver halide emulsion layer.

9. The photographic light-sensitive material as claimed in claim 1, wherein the hardened hydrophilic colloid layer is obtained by treating said photographic light-sensitive material with a processing solution containing said compound of the general formula (I) in an amount of about 0.1 to about 10% by weight of said processing solution.

* * * * *